US007478931B2

(12) United States Patent
Miletich et al.

(10) Patent No.: US 7,478,931 B2
(45) Date of Patent: Jan. 20, 2009

(54) LIGHTING FIXTURE SERVICE ACCESS

(75) Inventors: Don Miletich, Franklin, WI (US); Brian L. Kinnune, Racine, WI (US)

(73) Assignee: Ruud Lighting, Inc., Racine, WI (US)

( * ) Notice: Subject to any disclaimer, the term of this patent is extended or adjusted under 35 U.S.C. 154(b) by 1 day.

(21) Appl. No.: 11/478,781

(22) Filed: Jun. 30, 2006

(65) Prior Publication Data

US 2008/0002414 A1 Jan. 3, 2008

(51) Int. Cl.
*F21V 15/00* (2006.01)
*F21S 8/00* (2006.01)
*F21S 8/08* (2006.01)

(52) U.S. Cl. ..... 362/364; 362/147; 362/148; 362/365; 362/366; 362/418

(58) Field of Classification Search ..... 362/285, 362/147–148, 418, 427, 294, 370, 374–375, 362/432, 364–366, 382, 449, 457, 458
See application file for complete search history.

(56) References Cited

U.S. PATENT DOCUMENTS 4,293,895 A * 10/1981 Kristofek ..... 362/147
5,536,174 A 7/1996 Forish
6,059,424 A 5/2000 Kotloff
6,402,350 B1 6/2002 Ward
6,461,016 B1 * 10/2002 Jamison et al. ..... 362/147
6,632,006 B1 * 10/2003 Rippel et al. ..... 362/366
6,796,684 B1 9/2004 Beadle

* cited by examiner

*Primary Examiner*—Sharon E Payne
*Assistant Examiner*—Sean P Gramling
(74) *Attorney, Agent, or Firm*—Jansson Shupe & Munger Ltd.

(57) ABSTRACT

Apparatus includes a mounting plate having a hole in a center portion thereof, a recessed light support member having laterally-extending flanges on each of two essentially parallel sides, and a guide disposed on the top surface of the plate, the guide having a longitudinal section offset from the top surface by a distance greater than the thickness of the flanges, where the flanges of the recessed light support member are slidable laterally between the top surface of the plate and the longitudinal section of the guide. A method of servicing a lighting fixture having a can includes sliding the can laterally from a position where the can is centered over the hole to a position where a servicing space is effected between a perimeter of the hole and the can.

22 Claims, 12 Drawing Sheets

LIGHTING FIXTURE SERVICE ACCESS

FIELD OF THE INVENTION

The invention relates to servicing of lighting fixtures and, more particularly, to a structure and method that improves maintainability by simplifying access to lighting fixture components.

BACKGROUND OF THE INVENTION

Many different shapes and applications exist for lighting fixtures, and fixtures of a general shape/application can have several different lamps with various power dissipations, voltages, photometrics, radiation patterns, etc. One or more different lamp types can be used in a single lighting fixture. Lighting fixture housings may be optimized for a given application by adapting the shape and/or location of reflectors, diffusers, baffles, louvers, shades, shields, and other components for achieving the desired illumination within electrical, heat, and other parameters for the particular installation.

Lighting fixtures adapted to be recessed into a wall, such as by being disposed above a ceiling, are known. Such recessed lighting fixtures may have a dome shaped reflector housing or can be designed for securing one or more sockets for corresponding lamps including compact fluorescent, incandescent, HID, quartz, and other types. A particular lamp may need a ballast transformer or the like for supplying the lamp with necessary voltage. Conventional recessed lighting fixtures typically position the reflector housing, transformer, electrical junction box, and any other associated components on a frame or similar structure to be installed above the ceiling. A reflective insert is often inserted, from below, into the reflector housing so that a reflector extends from a position proximate the lamp to a position proximate the plane of the ceiling, thereby reflecting the light downward into a room. Such a reflective insert may also include a transparent or translucent lens.

A traditional recessed lighting fixture, as is typical for most lighting fixtures, requires periodic maintenance, such as relamping when a lamp is burned-out, replacing a ballast, accessing a junction box, replacing a socket, replacing a thermal protector, investigating the cause of a shutoff in a system having thermal protection and/or relays, etc. Although recessed lighting fixtures typically provide easy access for relamping from a position below the ceiling, any other maintenance or repair typically requires a service person to gain access to lighting fixture space above the ceiling. In such a case, there may be no problem if the recessed lighting fixture is part of a suspended ceiling. However, a recessed lighting fixture may be inaccessible from above, such as when the fixture is part of a drywalled or similar ceiling, or when there is no easy access in a suspended ceiling. A service person in such a conventional situation may then be required to spend a great deal of time in disassembling the fixture from below, attempting to crawl through an attic (if available), cutting through the drywall, or to perform other tasks. Besides being time consuming, such servicing may cause damage to the recessed lighting fixture, the ceiling, and/or other adjacent structure or articles.

OBJECTS OF THE INVENTION

It is an object of the invention to provide an improved recessed lighting fixture and servicing method overcoming some of the problems and shortcomings of the prior art, including those referred to above.

Another object of the invention is to provide a service access that facilitates servicing of components of a recessed lighting fixture from a position below the fixture.

Another object of the invention is to provide a service access that facilitates a servicing of a recessed lighting fixture installed in an otherwise inaccessible ceiling space, such as a space above a drywalled ceiling or the like.

Still another object of the invention is to provide an improved service access for a recessed lighting fixture installed in a location where access to lighting fixture components is otherwise difficult.

Yet another object of the invention is to provide an improved service access for a recessed lighting fixture where components are accessible without disassembly of the fixture.

Another object of the invention is to provide a modular lamp socketing assembly with improved heat dissipation.

Another object of the invention is to provide universality in configuring a basic fixture design for specific applications including varying of illumination, lamp type, socket type, reflector, heat dissipation properties, accessability of components, and of mechanical structure.

How these and other objects are accomplished will become apparent from the following descriptions and the drawings.

SUMMARY OF THE INVENTION

According to an aspect of the invention, a recessed lighting fixture includes a mounting plate ("plate") having a hole in a center portion thereof and having a top surface and a bottom surface, a light support member having laterally-extending flanges on each of two essentially parallel sides, the flanges having a thickness, and a guide disposed on the top surface of the plate, the guide having a longitudinal section offset from the top surface by a distance greater than the thickness of the flanges, where the flanges of the recessed light support member are slidable laterally between the top surface of the plate and the longitudinal section of the guide.

According to another aspect of the invention, apparatus includes a plate having a hole in a center portion thereof and having a top surface and a bottom surface, the hole defining a hole area, a light support member having a perimeter, the perimeter enclosing an illumination passage area, and a guide mounted to the top surface of the plate and adapted for limiting movement of the light support member in a direction normal to the top surface while allowing movement of the light support member in a direction parallel to the top surface, where the light support member is slidable between a first position where the illumination passage area covers the hole area and a second position that allows access, via the hole area, to space proximate the top surface.

According to another aspect of the invention, a recessed lighting fixture includes a plate having a hole in a center portion thereof and having a top surface and a bottom surface, a recessed light support member having laterally-extending members on each of two essentially parallel sides, the laterally-extending members each having a thickness, and a guide disposed on the top surface of the plate, the guide having a longitudinal section offset from the top surface by a distance greater than the thickness of the laterally-extending members, where the laterally-extending members of the recessed light support member are slidable between the top surface of the plate and the longitudinal section of the guide, so that the recessed light support member is slidable from a first position where the hole is covered by the recessed light support member to a second position where at least a portion of the hole is not covered by the recessed light support member.

According to another aspect of the invention, a method includes providing a plate having a hole in a center portion thereof and having a top surface and a bottom surface, the hole defining a hole area, providing a light support member having a perimeter, the perimeter enclosing an illumination passage area, and providing a guide mounted to the top surface of the plate and adapted for limiting movement of the light support member in a direction normal to the top surface while allowing movement of the light support member in a direction parallel to the top surface, where the light support member is slidable between a first position where the illumination passage area covers the hole area and a second position that allows access, via the hole area, to space proximate the top surface.

According to another aspect of the invention, a method of servicing a recessed lighting fixture is provided, the recessed lighting fixture including a plate having a hole in a center portion thereof, the plate having a top surface and a bottom surface, the recessed lighting fixture including a can with a lamp socket disposed therein, the method including sliding the can laterally from a position where the can is centered over the hole to a position where a servicing space is effected between a perimeter of the hole and the can.

As will be apparent, the terms "top" and "bottom" (e.g., "top surface" and "bottom surface") are used for convenience to refer to particular opposed sides of an object. For a preferred embodiment where the recessed lighting fixture is slidable horizontally, for example when the lighting fixture is installed in a ceiling, the top faces up and the bottom faces down. It will be understood that the lighting fixture of the invention may alternatively be installed so that such "top" and "bottom" are not necessarily disposed at positions relative to a horizontal plane. For example, the lighting fixture may alternatively be installed upside down for providing recessed uplighting, may be installed so that the recessed lighting fixture is slidable vertically, etc. In any case, the top surface of the plate of the fixture of the invention is the surface proximate the various lighting components and the bottom surface of the plate is the other surface (sometimes including part of a lens retainer, a lens, etc.). As used herein with reference to the fixture housing, the term "unibody" refers to a structure formed from a single piece of raw material.

The foregoing summary does not limit the invention, which is defined by the attached claims. Similarly, neither the Title nor the Abstract is to be taken as limiting in any way the scope of the disclosed invention.

BRIEF DESCRIPTION OF THE DRAWING FIGURES

Figure 11C:
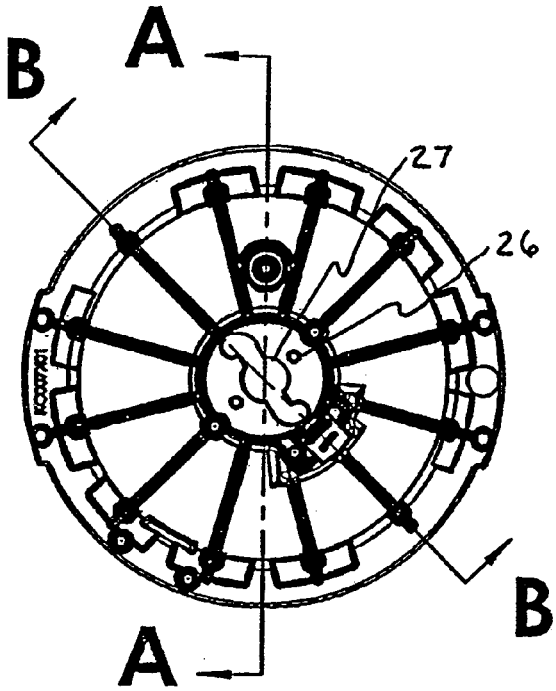
Figure 11D:
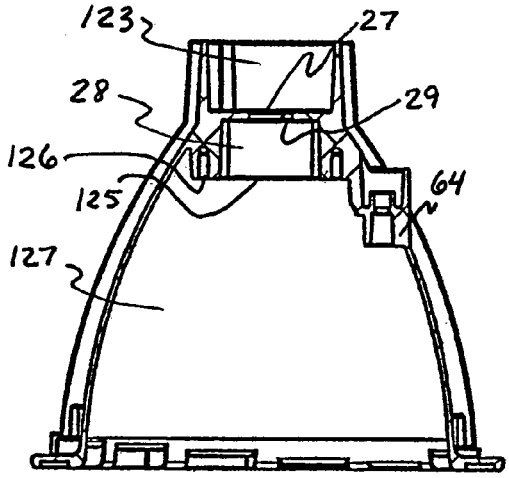
Figure 11E:
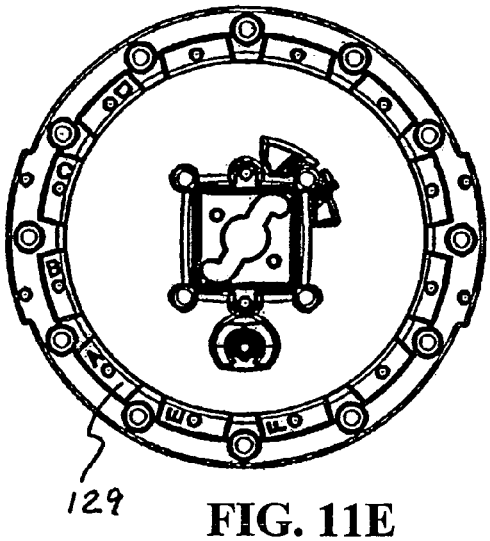
Figure 11F:
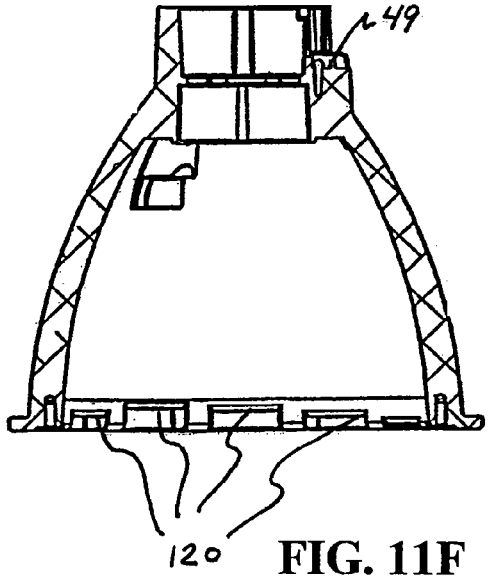

FIGS. 11A-11F respectively show, for a reflector housing, a side elevation view, a perspective view, a top view, a view along the line A-A of FIG. 11C, a bottom view, and a view along the line B-B of FIG. 11C, according to an exemplary embodiment of the invention.

Figure 12:
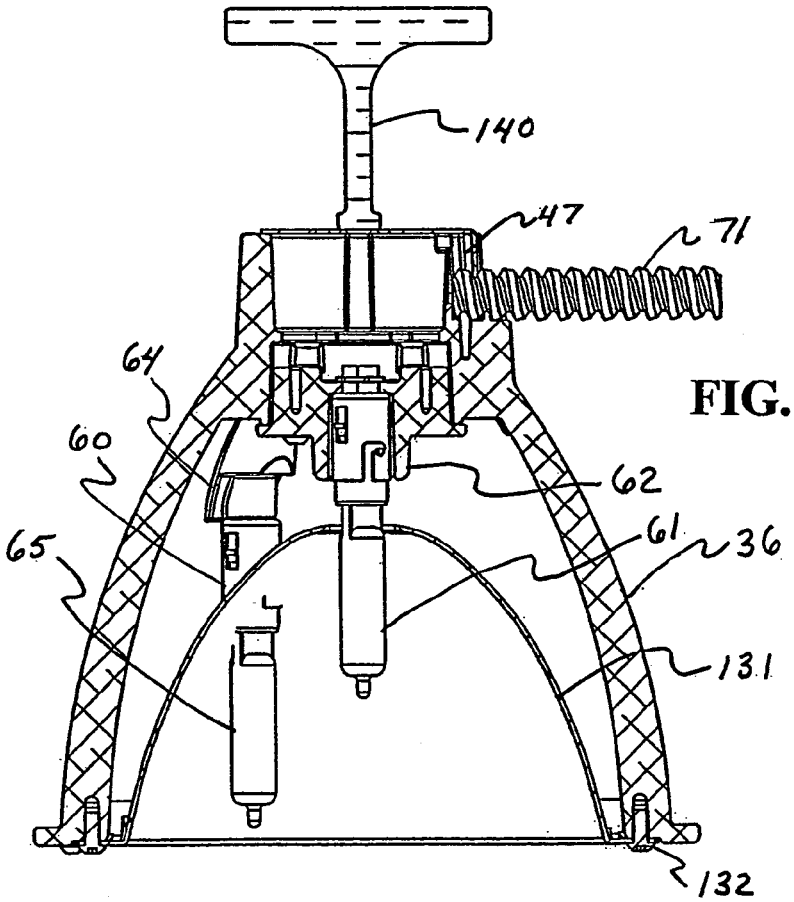

FIG. 12 is a cutaway side view of various components installed in and attached to a reflector housing, according to an exemplary embodiment of the invention.

FIGS. 13A-13K show different views and configurations for a socket assembly having improved heat dissipation and universality of configuration, according to exemplary embodiments of the invention.

DETAILED DESCRIPTION OF PREFERRED EMBODIMENTS

Figure 1:
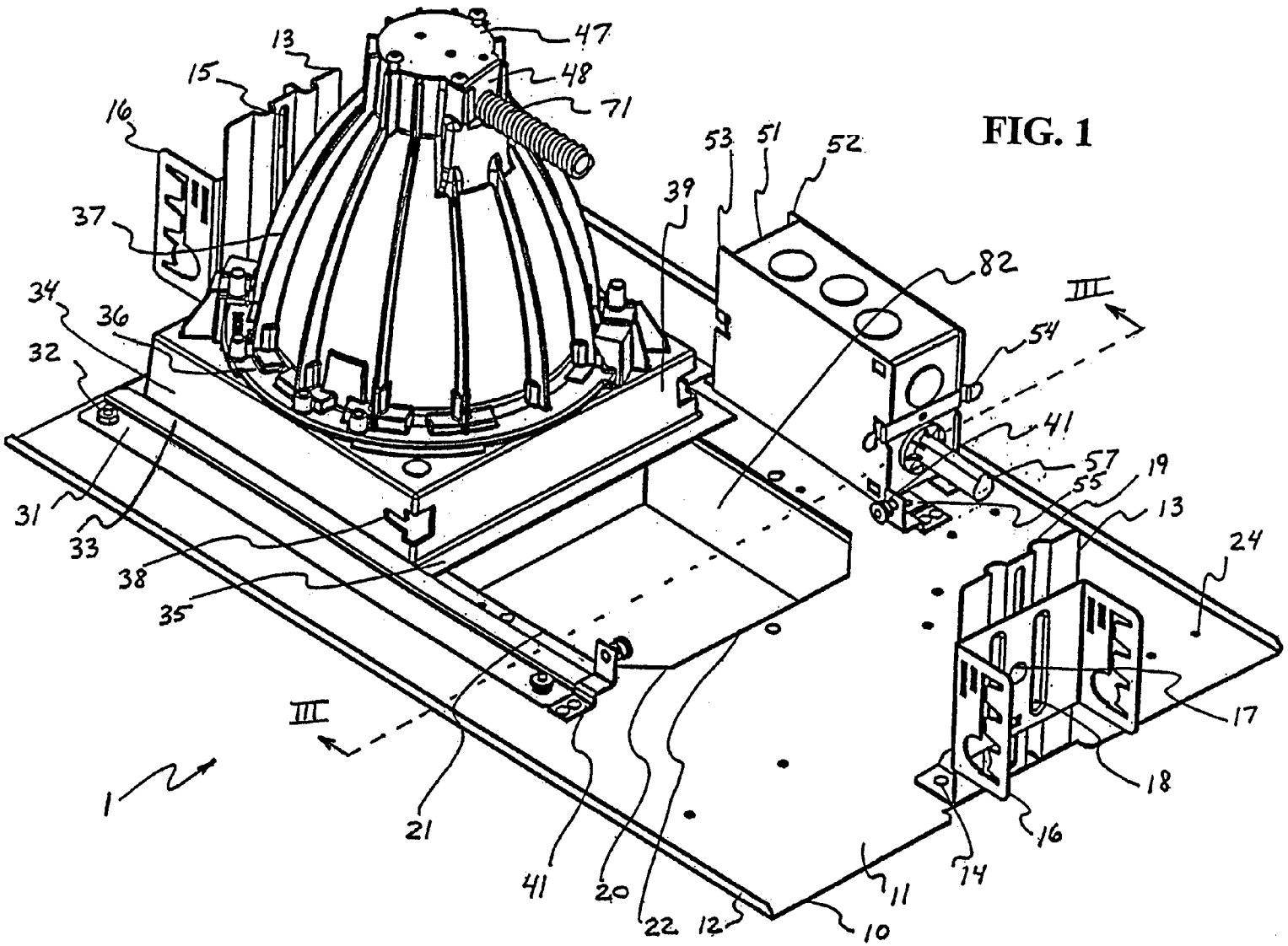
FIG. 1 is a perspective view of a recessed type lighting fixture in a servicing position, according to an exemplary embodiment of the invention.
Figure 2:
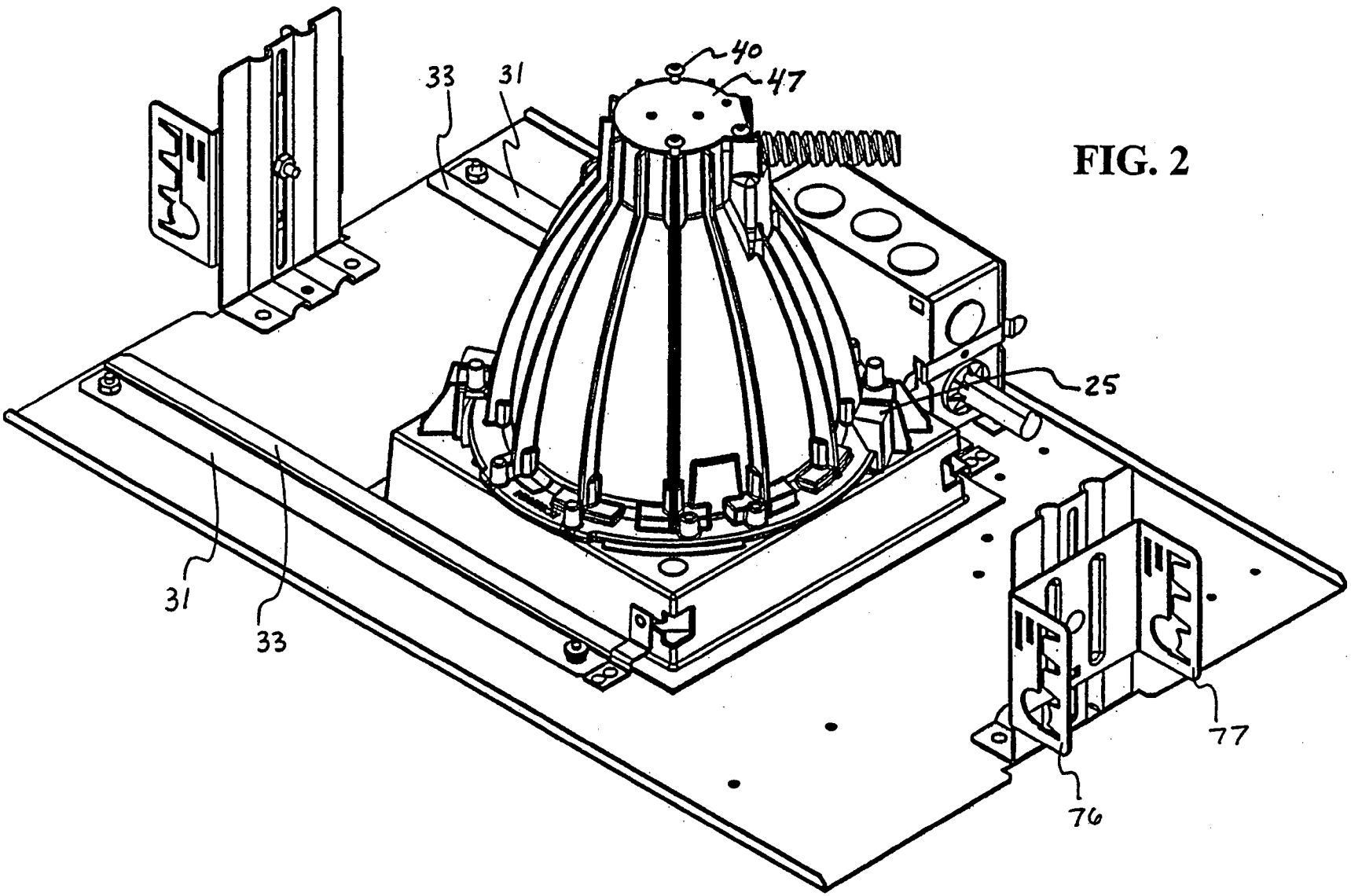
FIG. 2 is a perspective view of a recessed type lighting fixture in a closed/operating position, according to an exemplary embodiment of the invention.

FIGS. 1 and 2 respectively show perspective views of a recessed lighting fixture 1 in a servicing/maintenance orientation and in a closed orientation. A flat type mounting plate 10 is formed of sheet metal and has a top surface 11. Bent edge portions 12 are formed along each longitudinal edge of plate 10. An L-shaped bracket holder 13 is attached on each lengthwise end of plate 10 using rivets 14 or other suitable fastener. Bracket holders 13 each have a vertical groove 15 formed in a center portion thereof. A mounting bracket 16 is slidably attached to each bracket holder 13 with a fastener 17, such as a bolt and lockwasher combination. Mounting bracket 16 and bracket holder 13 respectively have projections 18 and indentations 19 that align to assure that mounting bracket 16 remains in alignment with bracket holder 13 as a vertical position of mounting bracket 16 is vertically adjusted and then tightened in place with mounting ear adjustment nut/fastener 17. The just-described apparatus may also be referred-to as an adjustable mounting ear assembly. Mounting brackets 16 are used for securing fixture 1 to a support structure. Lighting fixture 1 is illustrated with a pair of mounting brackets 16 each having holes formed therein on opposed extending walls 76, 77. Such holes allow an installer to secure lighting fixture 1 to a structure, for example, by placing connectors, solid conduit, wire, fastener, etc. therethrough, and then attaching such conduit, wire, or fastener to the given structure. Any other known apparatus may also be used for mounting lighting fixture 1 to a ceiling or other structure.

Mounting plate 10 is formed to have a hole 20 formed in a central location. Longitudinal Z-channel members 31 are mounted on top surface 11, in the illustrated example, essentially in parallel with sides 21 of hole 20, using fasteners 32 to secure Z-channel members 31 on opposite sides of hole 20. Each Z-channel member 31 has an upper longitudinal portion 33 that is offset at a distance above top surface 11, creating an offset space due to the Z shape. A cast light support member 34 has laterally-extending flanges 35 on each of its sides, flanges 35 having a thickness less than the offset of the upper longitudinal portions 33 of Z-channel members 31. As a result, cast light support member 34 is able to slide back and forth between the respective open and closed positions of FIGS. 1 and 2, with the flanges 35 being guided along the offset spaces of opposed and essentially parallel Z-channels 31. As shown in FIGS. 1 and 2, one of the two Z-channels 31 may extend a shorter distance compared with the other. Structure other than or in addition to flanges may alternatively be used for guiding light support 34 along longitudinal guides, such as roller wheels, bearings, etc.

Light support member 34 is preferably formed by casting a metal such as aluminum or other suitable metal, or alternatively may be formed of an injection molded polymeric (plastic) type material, into a shape having flanges 35 and a box-like structure adapted for attaching a reflector housing 36. Reflector housing 36 is also preferably formed by casting a suitable metal such as aluminum, or alternatively by forming of an injection molded polymaric (plastic) material, into a form having a domed shape and having additional metal volume, such as ribs 37, for increasing heat sinking and dissipation. Light support member 34 has a hole of a same general shape as the dome of reflector housing 36, so that light from reflector housing 36 passes therethrough. The mating surfaces between light support member 34 and reflector housing 36 are preferably flush with one another, thereby transferring heat therebetween for optimal heat dissipation.

Fasteners 41 are attached, such as by using rivets or the like, to top surface 11 on opposite sides of hole 20 adjacent the service access end 22 of hole 20. Fasteners 41 in the illustrated example each include a bracket having a shape that coincides with the shape of Z-channel members 31, with the addition of a vertical section threaded to receive a threaded nut such as a thumbnut. The threaded nut, when loosened, on either side of hole 20 is positioned to fit into a corresponding slot 38 formed on the respective corner of light support 34. After light support 34 has been pushed into the closed position shown in FIG. 2, the nuts of fasteners 41 are tightened by a service person from the inside of light support 34 via hole 20, thereby locking light support 34 and the attached reflector assembly to frame 10. Similarly, when service access is desired, light support 34 may be loosened to be slid to the service access position shown in FIG. 1, by loosening the nuts of fasteners 41 from the underside of fixture 1 via hole 20. Such allows field maintenance to be performed without disassembling the fixture.

A junction box 51 is secured to top surface 11 with rivets or the like being attached via holes in mounting tabs 55 of junction box 51. A rear plate 52 covers one side of junction box 51 and is attached thereto by engagement of tabs and slots (not shown) at one end and by an affixed clip 54 at the other end. A front plate 53 covers the other longitudinal side of junction box 51 and is similarly attached, except that clip 54 is not affixed to front plate 53 but merely acts in a moveable leaf spring arrangement so that clip 54 may be moved to release front plate 53 to be removable from junction box 51. Such a release of clip 54 may be performed by a service person via hole 22, and components of junction box 51 may then be serviced. Such components (not shown) may include, but are not limited to, wires, conduit fittings, connectors such as twist-on wire connectors, ballasts, switches, dimmers, communications equipment, relays, sensors, etc. As shown, a thermal protector 57 protects fixture 1 from overheating, such as in an event where an incorrect lamp is installed or, for example, per NEC Article 410-66, in an event where insulation is inadvertently installed above or around fixture 1. Thermal protector 57, for example, may trigger a relay or similar switch for shutting off power when an over-temperature condition is sensed, and may then reset itself after a cooling off period. Although shown in FIGS. 1 and 2 installed near hole 22, junction box 51 may alternatively be installed in an end mounting location 24.

Figure 3:
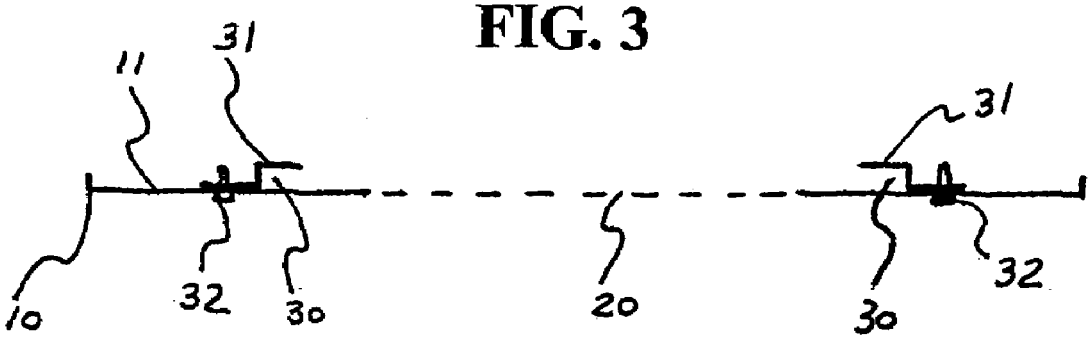
FIG. 3 is an elevation view taken along the line III-III of FIG. 1, shown without a junction box.
Figure 4:
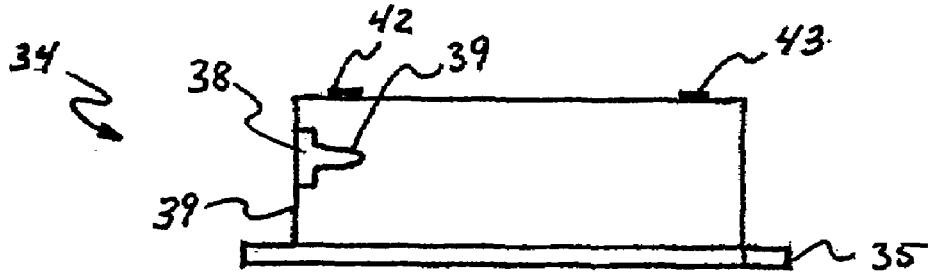
FIG. 4 is an elevation view of a light support casting, shown without twist-lock stops, according to an exemplary embodiment of the invention.

FIG. 3 is an elevation view taken along the line III-III of FIG. 1, except that hole 20 is shown as a dashed line rather than being shown as a distal end of hole 20. The spaces 30 between top surface 11 and Z-channels 31 have a vertical height greater than a height of flanges 35 of light support 34, so flanges 35 are able to slide freely within spaces 30. Although the illustrated embodiments utilize Z-channels, any other guide structure or slide rail(s) may be used for allowing light support 34 to slide along frame 10. FIG. 4 is a side elevation view of light support 34, showing an example of a slot 38 for receiving the threaded shaft of fastener 41. When light support 34 is slid laterally along longitudinal spaces 30, such threaded shafts of opposed fasteners 41 enter slots 38 of corresponding opposite sides of light support 34, and such threaded shafts become seated into respective securing ends 39. With the threaded shafts seated, light support 34 is at its operating position, and the service person then fastens the nuts onto the threaded shafts of fasteners 41 to hold light support 34 in place. Other alternative fasteners 41 (not shown) may include, but are not limited to, leaf springs adapted to engage notches in light support 34, clips, connectors, quick-release devices, and the like.

Figure 5:
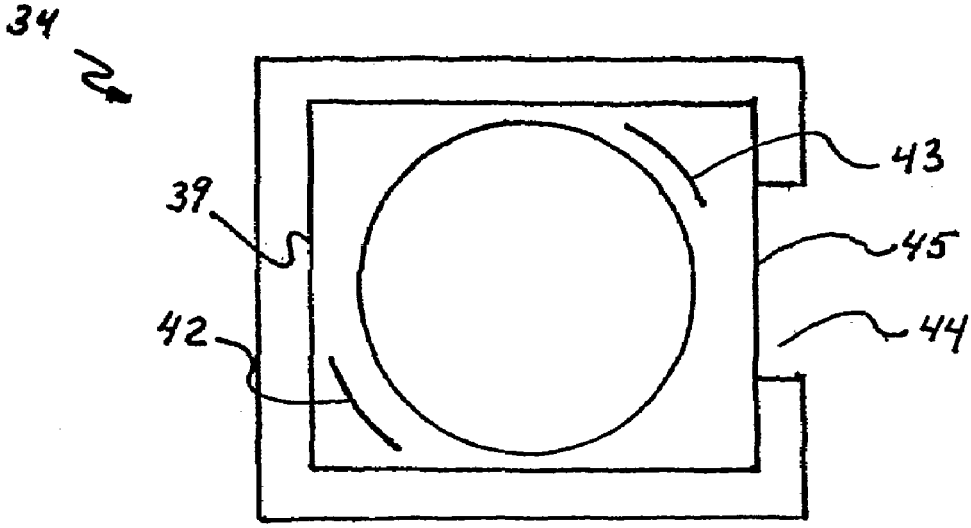
FIG. 5 is a top view of the light support of FIG. 4.

FIG. 5 is a top view of light support 34. In the present example, flanges 35 are formed on all four sides of light support 34, with a cutout portion 44 formed on a flange 35 of one side. In one embodiment, cutout 44 allows light support 34 to slide until an abutment surface 45 thereof abuts bracket holder 13. Light support 34 has curved guide projections 42, 43 formed to assist installation of reflector housing 36 onto light support 34. In a preferred embodiment, guide projections 42, 43 are curved portions that have a same curvature as that of the mounting surface of reflector housing 36 and that are disposed to allow reflector housing 36 to be precisely situated between guide projections 42, 43 and then fastened to light support 34 at the desired location by use of one or more fastening members (not shown). Additional alignment structure may be provided for securing reflector housing 36 at a predetermined position. Further description of reflector assemblies and their mounting are discussed further below.

Figure 6:
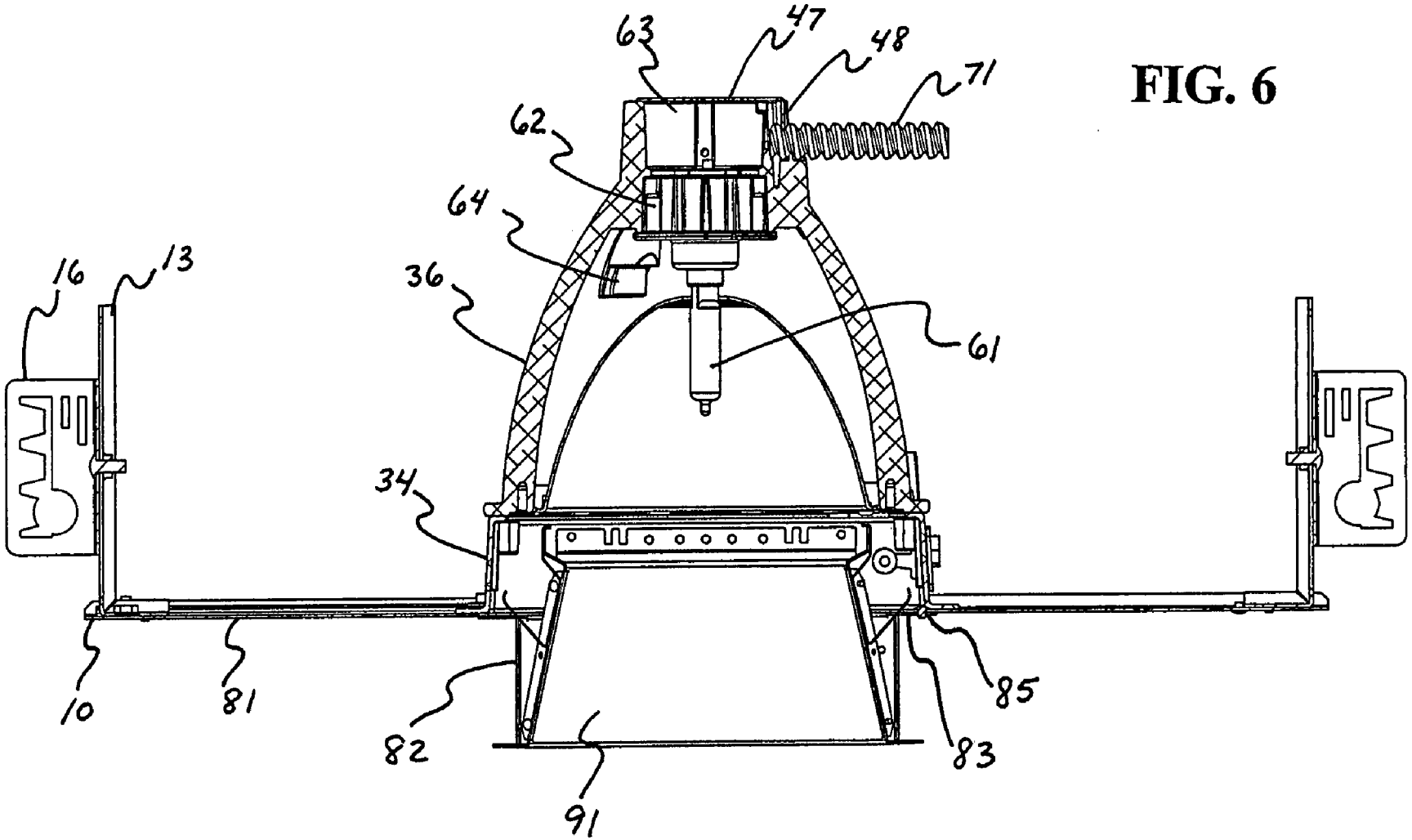
FIG. 6 is a side view of the lighting fixture of FIG. 2 with a reflective insert installed.

FIG. 6 is a cutaway side view of a fixture 1 having a primary lamp 61 mounted in a socket assembly 62. Lamp 61 may be any suitable type that fits into a given size reflector housing 36 including, but not limited to compact fluorescent, HID, quartz, incandescent, etc. Socket assembly 62 is attached to an upper compartment 63 of reflector housing 36. A removable cover 47 is attached to the topmost part of reflector housing 36 with screws or the like. A conduit 71 is attached to reflector housing 36 with a strain relief panel 48 and is used for feeding electrical wires to compartment 63. Cover 47 and strain relief 48 may be combined into a single structure. A light passage housing 82 is attached on the bottom surface 81 of plate 10, such as by using rivets or the like. In a preferred embodiment, light passage housing 82 is rectangular and has flanges extending to be coplanar with one another, with holes in the flanges for the riveting to bottom surface 81. As shown, flange 83 of light passage housing 82 is installed by being inserted into notch 85 formed in bottom surface 81 to assist proper alignment prior to the riveting. In the illustrated example, a second socket assembly 64 is provided for a secondary light, such as an emergency light having its own separate electrical feed, as shown in FIG. 7.

Figure 7:
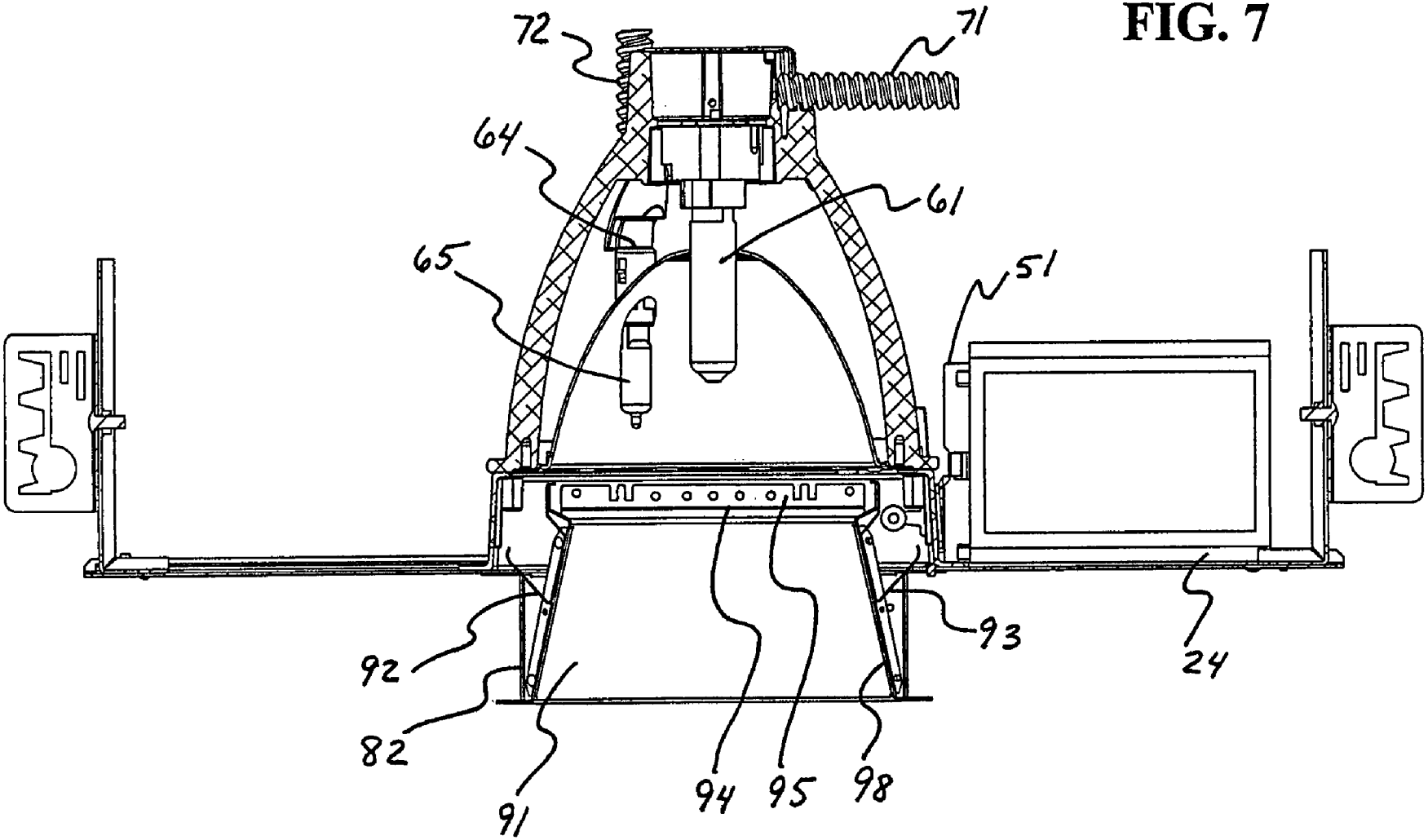
FIG. 7 is a side view of the lighting fixture of FIG. 2, shown with a junction box and with two DC bayonet type lamps.

FIG. 7 is a cutaway side view of a fixture 1 having a removable insert 91 that includes leaf springs 92, 93 which maintain a snug fit for insert 91 when it is installed into light passage housing 82. Leaf springs 92, 93 abut reflective walls 98 and apply increasing holding force against walls 98 as insert 91 is pushed upward by an installer. Insert 91, when installed with light support 34 in the operating position, extends through hole 20 and up into light support 34. A top portion of insert 91 has a lens holder platform 94 at the bottom of a lens placement and retaining portion 95. A lens (not shown) is held on platform 94 by tabs or the like formed in retaining portion 95. Insert 91 preferably has reflective surfaces 96 on the interior portion thereof, and insert 91 may be formed entirely of a single reflective material. Junction box 51 is shown mounted at side position 24.

Figure 8:
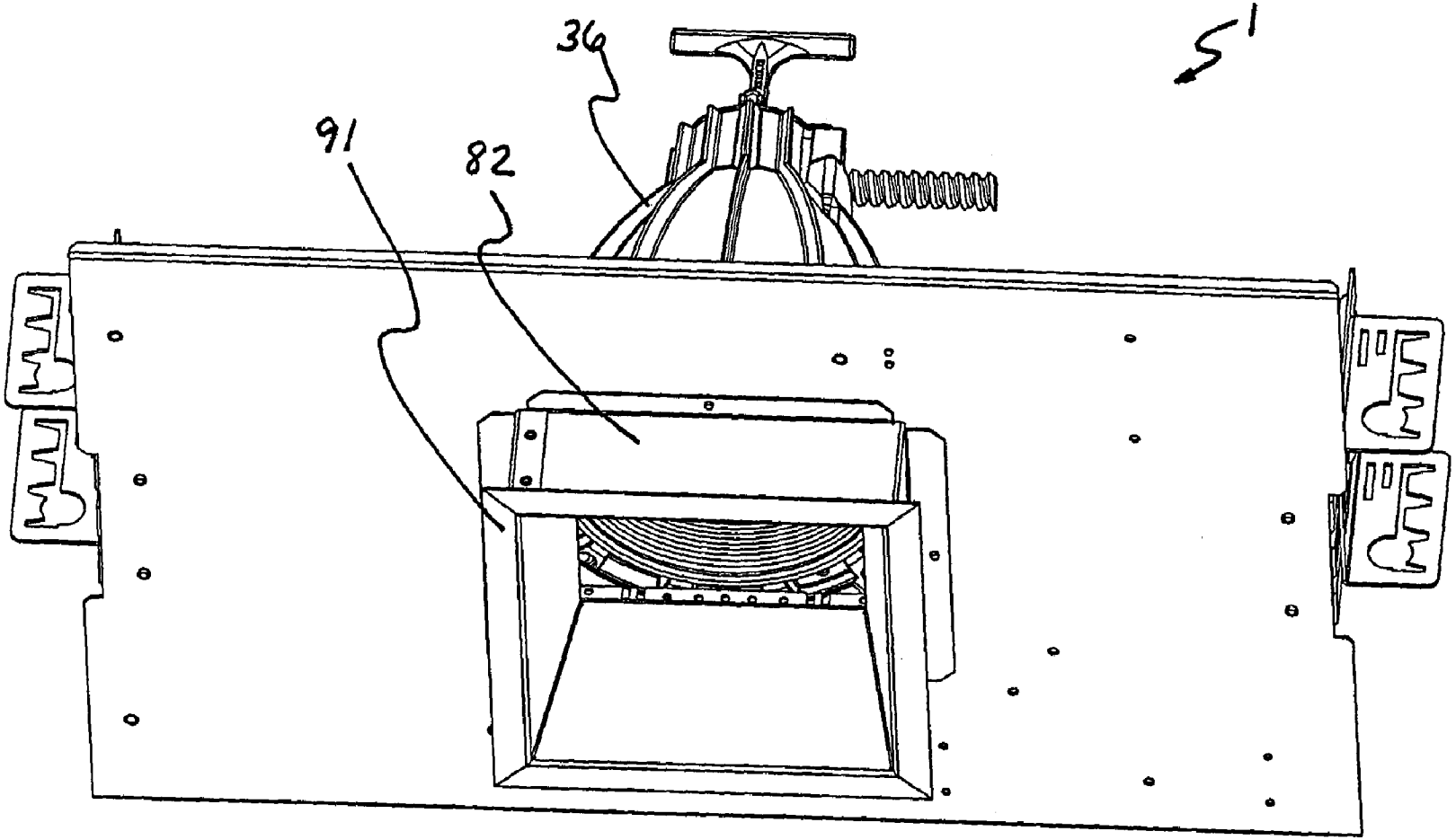
FIG. 8 is a bottom perspective view of the lighting fixture of FIG. 2, shown with an optional handle secured to the top of the main reflector housing.
Figure 9:
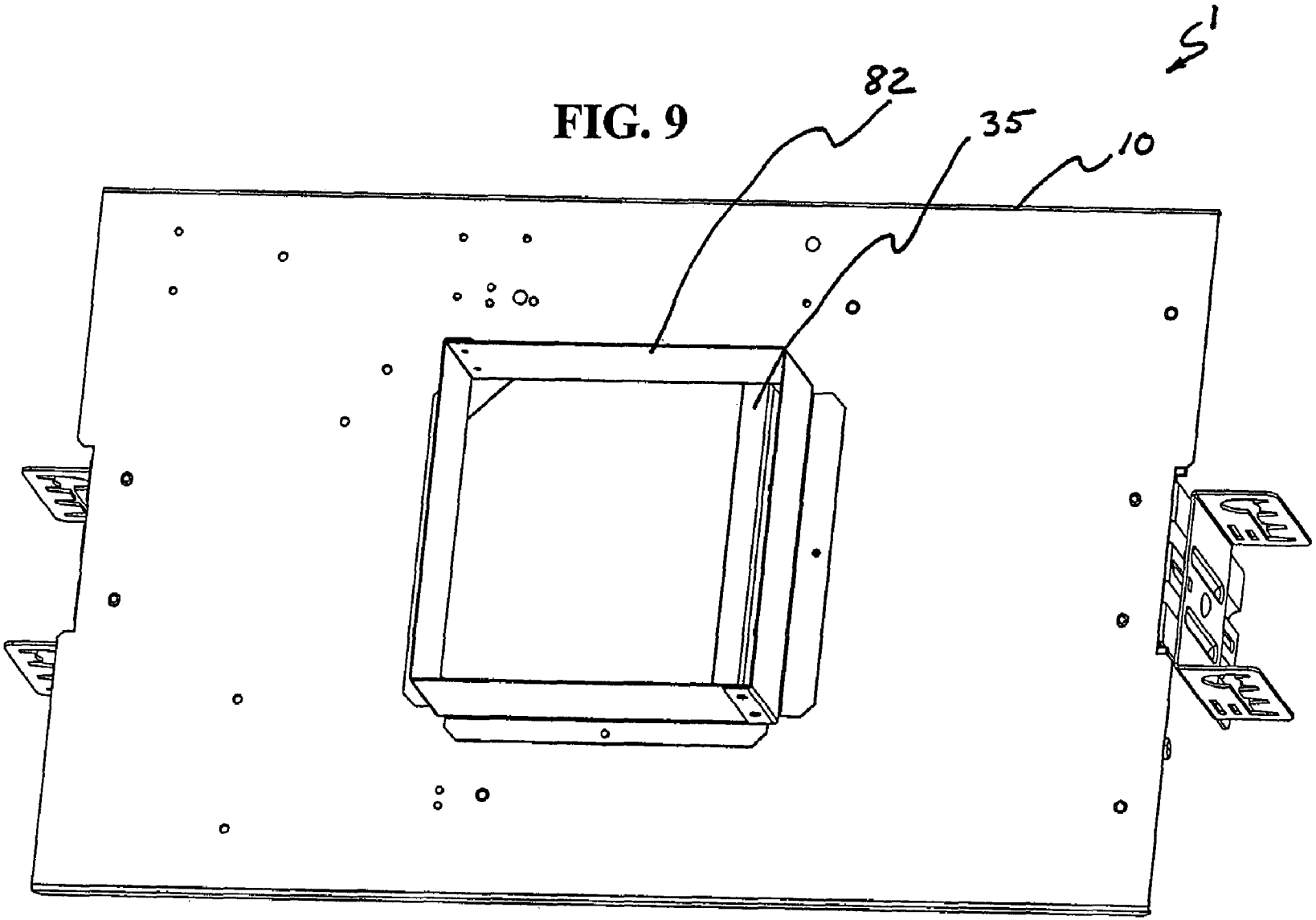
FIG. 9 is a bottom perspective view of the lighting fixture of FIG. 1 in the servicing position.
Figure 10:
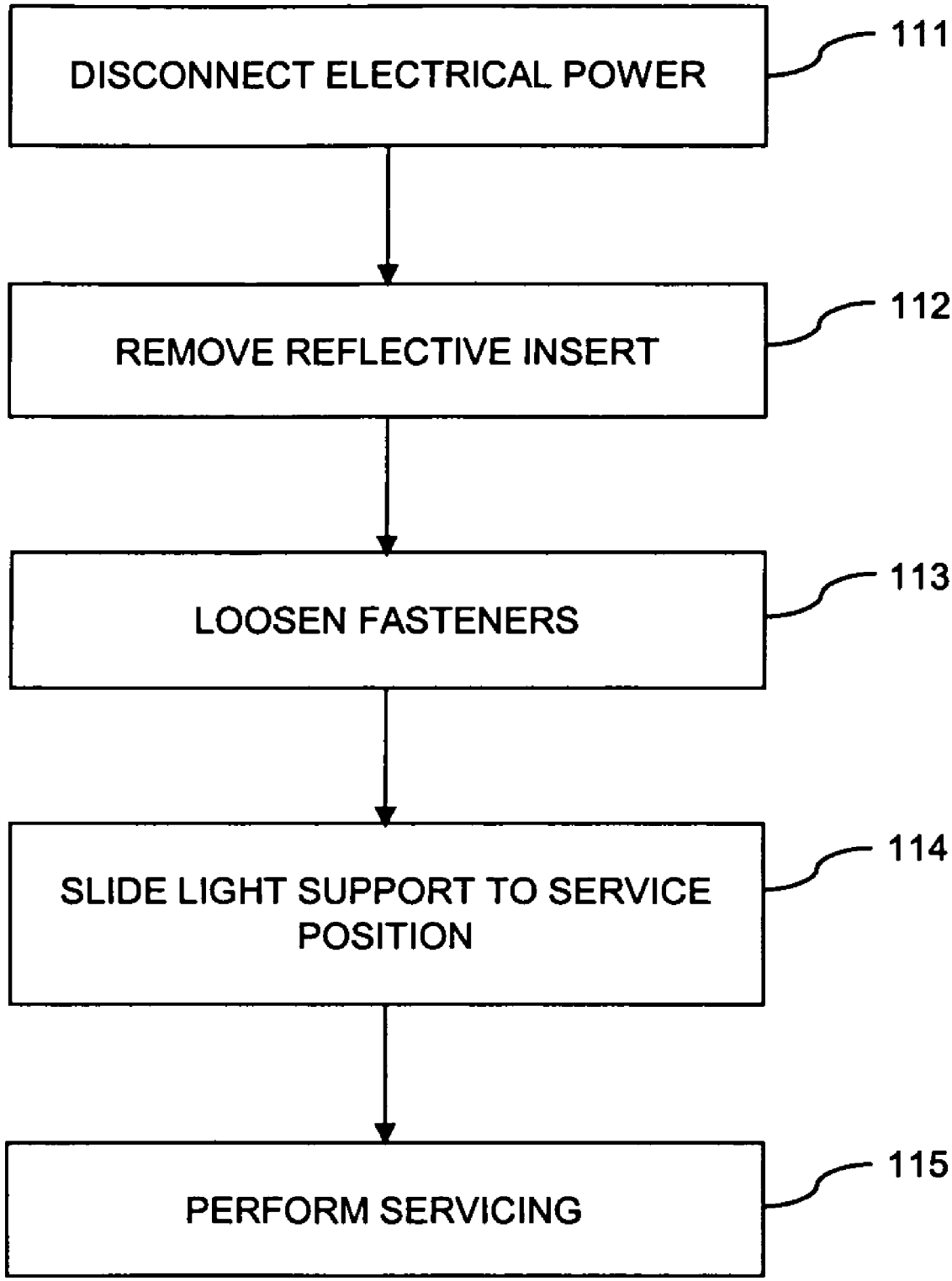
FIG. 10 is a flowchart for a method of servicing a recessed lighting fixture, according to an exemplary embodiment of the invention.
Figure 11A:
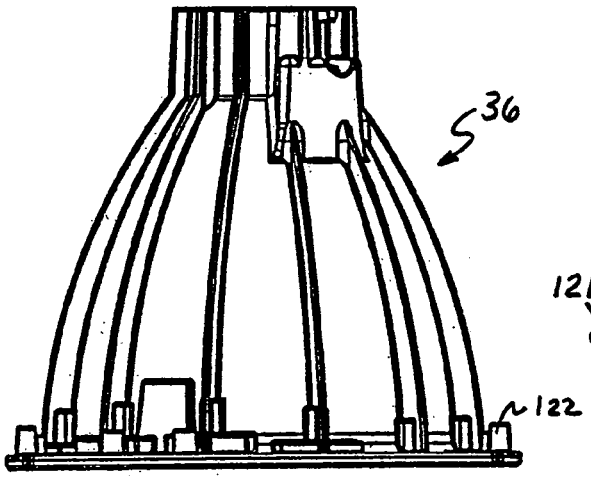
Figure 11B:
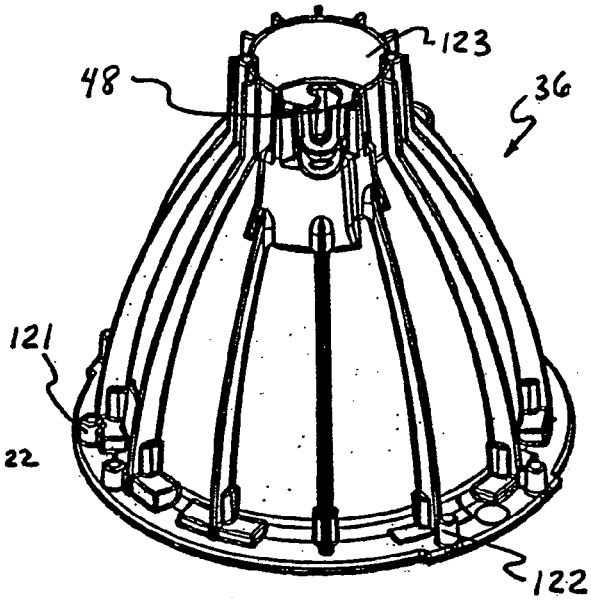

FIGS. 8 and 9 respectively show perspective views of lighting fixture 1 in a closed and operational state, and in an open servicing state. FIG. 10 is a flowchart of an exemplary method of performing servicing on an installed lighting fixture 1. First, at step 111, the service person shuts off the circuit breaker feeding electrical power to fixture 1. At step 112, reflective insert 91 is removed by grasping the rims thereof and pulling down so that the sides of insert 91 become disengaged with leaf springs 92, 93 holding insert 91 in place. After setting reflective insert 91 aside, the service person reaches up through light passage housing 82 and loosens the thumbnuts of fasteners 41 at step 113 so that light support 34 is no longer fastened to fasteners 41. At step 114, the service person slides light support 34 in a lateral direction away from fasteners 41, such as by pushing against flange 35, until light support 34 is at a servicing position. At step 115, servicing of lighting fixture 1 is performed via housing 82.

FIGS. 11A-11F respectively show, for reflector housing 36, a side elevation view, a perspective view, a top view, a view along the line A-A of FIG. 11C, a bottom view, and a view along the line B-B of FIG. 1C. Quartz restrike mounts 121 are provided as an integral part of the casting for par lamp fixtures. Bosses 122 are also cast integrally for twist-lock type engagement with a locking stop boss assembly, as described in co-pending U.S. patent application Ser. No. 11/478,818, entitled "Top Relamping System," incorporated herein in its entirety. A top wiring compartment 123 allows for wiring connections and extra wire, and is provided with a strain relief section 48 for securing conduit 71 thereto, for example including a conduit cover and locking screw boss(es), or an integral power feed conduit lock 49. At the bottom of compartment 123 is an access hole 27 having a universal clearance pattern allowing different type sockets to be mounted in a first socket assembly space 28 and accommodate wiring thereto. For example, G-12 wiring and mounting of DC bayonet and mini-candelabra sockets may be accommodated completely within space 28. A mounting surface 29 within space 28 has threaded screw attachment holes for securing such a socket assembly within space 28. The bottom walls of space 28 form an additional socket assembly mounting surface 125 that is laterally extended to include threaded mounting holes 126, and such may be used for mounting a cast type socket assembly 62 where a heat conducting portion thereof is within space 28, and where a socket and surrounding portion extends into internal reflector space 127. Socket assembly 62 is further described below. A second socket mount assembly 64 is integrally cast in reflector housing 36, providing a direct mount conduit connection and knock-out wire access, and being adapted for receiving a quartz restrike DC bayonet type socket therein. The bottom perimeter surface of reflector housing 36 has an integral series of annularly arranged steps 120 for varying the vertical level of mounting of a reflector therewithin. Each step 120 has a corresponding screw hole for securing a mounting tab of a reflector thereto. Such allows an installer, service person, or customer to implement or change the light distribution by varying vertical reflector position. For ease of manufacturing assembly and field adjustment of the reflector assembly, step level markings 129 are provided to assure correct optical distributions by referencing the placement with a letter.

FIG. 12 shows a reflector housing 36 with a socket assembly 62 having a same casting as that of housing 36, effecting efficient heat transfer therebetween. A reflector 131 is mounted to housing 36 using screws 132. Reflector 131 has a center hole that allows lamp 61 to pass therethrough, and has a hole in a sidewall portion that allows lamp 65 and socket 60 to pass therethrough. Such allows the lamps to remain static regardless of the distribution effected by reflector 131. Socket 60 is secured into the integrally cast portion secondary socket assembly 64, which has a wire passageway and a conduit mount for feeding electrical power to socket 60. The conduit 71 separately providing power to lamp 61 is locked into place using integrally formed strain relief portion 48 along with a locking screw and cover 47. A handle 140 is attached to housing 36 by two screws 40. Handle 140 has a height that may be used as a reference for placement of lighting fixture 1 in a facility. For example, the top of handle 140 may be placed six inches below a rafter. In other applications, handle 140 may be used for twist locking and unlocking of housing 36 from light support 34, as detailed in co-pending U.S. patent application Ser. No. 11/478,818. Cast reflector housing 36 may be configured to allow multiple light sources through use of integral mounting, bracketry, and cast socket mounting inserts. Housing 36 is preferably designed to keep the lamp light center(s) of lamp(s) mounted therein at a constant position at all times. The optical performance and distribution variances are created by mounting reflector 131 to chosen integral mounting steps 120. This allows a user to vary optical performance by simply moving or replacing (e.g., alternate reflective materials or shape) reflector 131. Such changes may be made from below fixture 1 without disassembling fixture 1. Housing 36 is adapted to accept various sockets and lamps. For example, a first casting is designed to be used for T4 quartz, T4/T6 metal halide, and Par 20 lamp sources. A second type casting removes the base socket mount to allow utilization of A19/BT15/Par30/Par38 incandescent, ED17/Par30L/Par38 HID, and PLT compact fluorescent sources. Cast reflector housing 36 also incorporates integral quartz restrike (QEM) socket and conduit mounting and integral power feed conduit locking to allow conduit feeds without any use of additional connectors. When using Par30/Par38 lamp sources, the secondary integral QEM mounting is used.

Figure 13A:
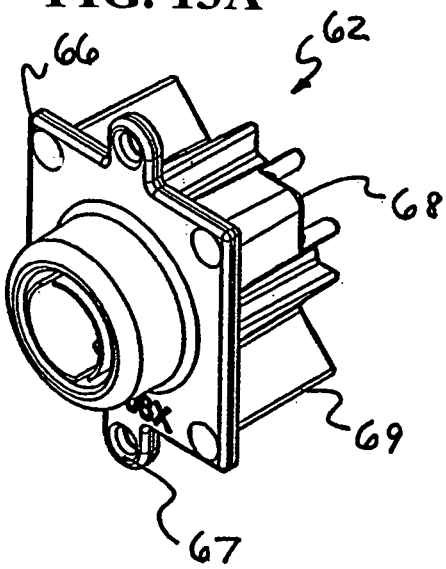
Figure 13B:
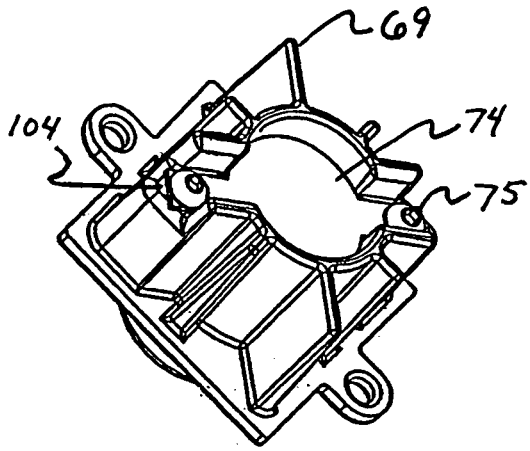
Figure 13C:
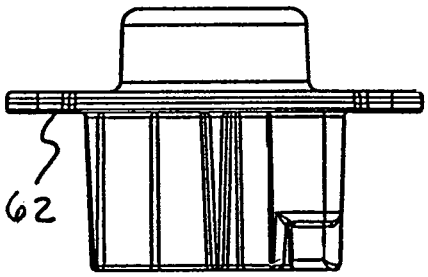
Figure 13D:
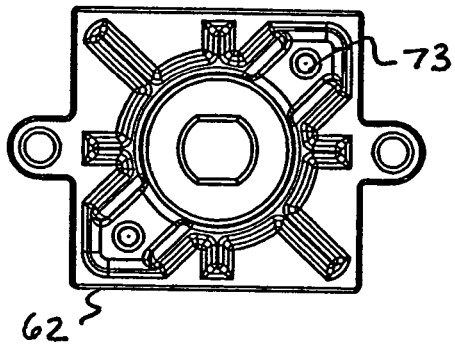
Figure 13E:
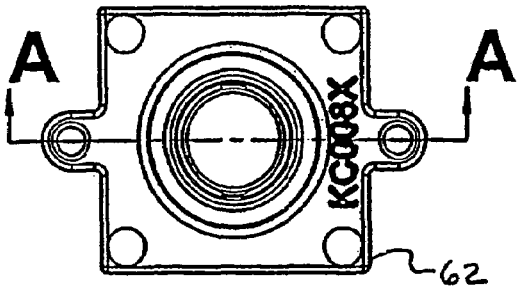
Figure 13G:
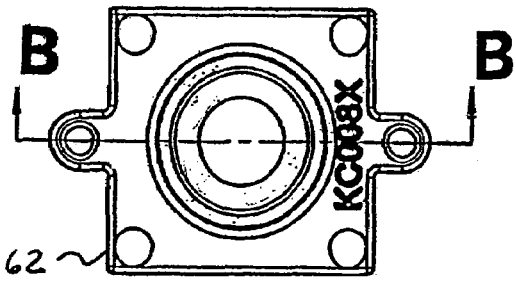
Figure 13F:
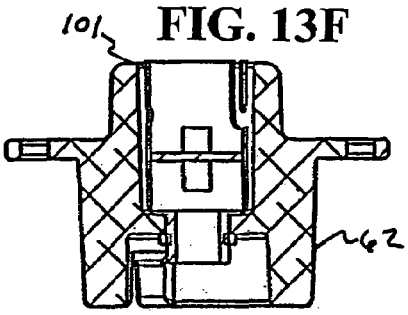
Figure 13H:
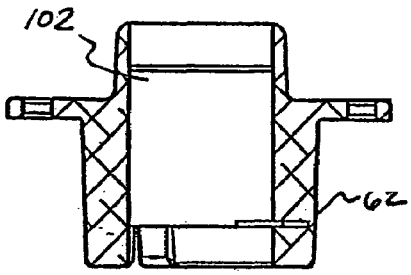
Figure 13I:
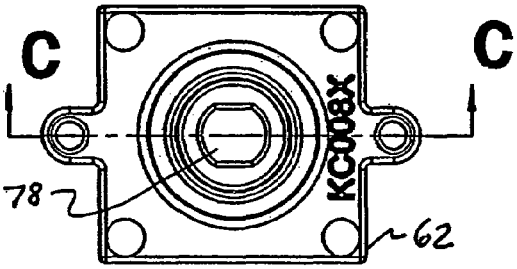

FIGS. 13A-13K show a lamp socket assembly 62, and some variations thereof, having a heat sinking ability and adapted for receiving a lamp 61. Socket assembly 62 is preferably formed by casting of a same type and material as is used to manufacture light support 34 and reflector housing 36, thereby effecting efficient heat transfer when such structures abut one another. Preferably, lamp socket assembly 62 has a shape and size to mate with reflector housing 36 in a manner that provides consistent lamp positioning and thermal conductivity for socket temperature management. FIGS. 13A-13B are perspective front and rear views, FIGS. 13E, 13G, and 13I are top views, and FIGS. 13C-13D respectively are side and bottom views of socket assembly 62. A top plate 66 of socket assembly 62 is formed with a shape suitable for enclosing a space between upper compartment 63 and the lower open dome portion of reflector housing 36. For example, top plate 66 is secured to threaded receptacles of reflector housing 36 with fasteners (not shown) via mounting holes 67. A base portion 68 extends into upper compartment 63 and provides heat radiating surface area by use of multiple fins 69. A mini-candelabra socket mounting plate 74 is secured to footings 104 with machine screws 75 being fastened into cored holes 73.

Figure 13J:
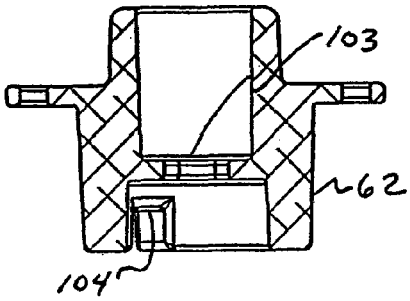
Figure 13K:
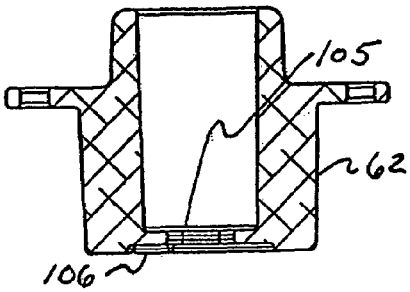

Socket mounting casting allows use of several different lamp bases by switching sockets in the casting 62. For example, DC bayonet, mini-candelabra, and others may be utilized, where positioning of integrated socket mounting positions allows for consistent lamp center location regardless of the particular base style used, thereby assuring consistency of optical performance and distribution. FIG. 13E shows a first type DC bayonet socket assembly that allows for anti-twist on a nipple mount socket where the bottom base level assures lamp position. FIG. 13F is a cutaway view along line A-A of FIG. 13E showing relative positioning of a DC bayonet socket 101, which mounts from the top (lamp) side of the casting 62. By comparison, FIG. 13G shows a mini-candelabra type socket assembly that mounts from the bottom side of the casting. FIG. 13H is a cutaway view along line B-B of FIG. 13G, showing an exemplary mini-candelabra socket 102. FIG. 13I shows an elongated double D hole 78 that allows for an anti-rotation mount with a nipple mounted DC bayonet socket. FIGS. 13J and 13K are each cutaway views along line C-C of FIG. 13I, where FIG. 13J shows an exemplary socket mount casting for a 250 Watt T4 quartz incandescent lamp, where a DC bayonet socket bottom base level 103 is provided for a top mount DC bayonet socket, and where a mini-candelabra socket footing level 104 is provided for a bottom mount mini-candelabra socket. FIG. 13K shows an exemplary socket mount casting for a 500 Watt T4 quartz incandescent lamp, where internal base 105 and bottom footing 106 are shifted down approximately 0.550 inch to accommodate the larger 500 Watt lamp.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use (s) of the present invention. It is intended that the appended claims be construed to include alternative embodiments to the extent permitted by the prior art.

What is claimed is:

1. A recessed lighting fixture comprising:

a plate defining a light opening therethrough and having top and bottom surfaces;

a slidable light support member including (a) a perimeter that defines an illumination passage area and (b) two essentially parallel laterally-extending flanges each having a thickness; and a guide disposed on the top surface of the plate, the guide slidably engaged by the light support member and adapted for limiting movement thereof in a direction normal to the top surface while allowing movement thereof in a direction parallel to the top surface, the guide includes a pair of spaced channel members each having a longitudinal section offset from the top surface by a distance greater than the thickness of the flanges to form an offset space, wherein the flanges of the light support member are slidable in the offset spaces between a first position where the illumination passage area is aligned with the light opening and a second position that allows access via the light opening to space proximate the top surface.

2. The recessed lighting fixture of claim 1 further comprising first and second mounting brackets adapted for securing respective opposite ends of the plate to a ceiling structure.

3. The recessed lighting fixture of claim 1 further comprising a securing member for preventing the lateral sliding of the light support member.

4. The recessed lighting fixture of claim 3 wherein the securing member includes at least one fastener adapted for tightening attachment of the light support member to the plate.

5. The recessed lighting fixture of claim 4 wherein the fastener includes a bracket, a stud, and a nut.

6. A recessed lighting fixture, comprising:

a plate defining a light opening therethrough and having a top surface and a bottom surface;

a light support member on the top surface over the light opening and having essentially parallel laterally-extending members on each of two opposite sides, the laterally-extending members each having a thickness; and a guide disposed on the top surface of the plate, the guide having a longitudinal section offset from the top surface by a distance greater than the thickness of the laterally-extending members, wherein the laterally-extending members of the light support member are slidable between the top surface of the plate and the longitudinal section of the guide, so that the light support member is slidable in a direction parallel to the top surface from a first position where the light support member is aligned with the light opening to a second position where at least a portion of the light opening is not covered by the light support member.

7. The recessed lighting fixture of claim 6 wherein the light support member includes:

a lamp housing having an interior lamp placement space; and a cast metal structure adapted for dissipating heat produced in the lamp placement space.

8. The recessed lighting fixture of claim 6 wherein the light support member includes (a) a base member having the laterally-extending members and (b) lamp housing secured with respect to the base member.

9. The recessed lighting fixture of claim 6 further comprising a frame member attached to the bottom surface of the plate and formed to at least partly surround the hole of the plate and extend outwardly from the bottom surface.

10. The recessed lighting fixture of claim 9 further comprising a lens removably attached to the frame member, the lens including a transparent plate and a reflector.

11. The recessed lighting fixture of claim 6 further comprising at least one stop that limits the movement of the light support member in a direction parallel to the top surface.

12. The recessed lighting fixture of claim 11 wherein the at least one stop comprises at least one locking fastener adapted for securing the light support member at the first position.

13. The recessed lighting fixture of claim 12 wherein the locking fastener includes a bracket, a stud, and a nut.

14. The recessed lighting fixture of claim 11 further comprising first and second mounting brackets adapted for securing respective lengthwise ends of the plate to a ceiling structure, and wherein the at least one stop includes one of the mounting brackets, which abuts the light support member at the second position.

15. The recessed lighting fixture of claim 6 wherein the guide comprises a pair of parallel channels respectively disposed on opposite sides of the light opening.

16. The recessed lighting fixture of claim 15 wherein the channels are Z-channels.

17. The recessed lighting fixture of claim 6 wherein the laterally-extending members are flanges.

18. The recessed lighting fixture of claim 6 wherein the laterally-extending members include bearings.

19. An apparatus comprising:

a plate having a hole in a center portion thereof and having a top surface and a bottom surface, the hole defining a hole area;

a slidable light support member having a perimeter, the perimeter defining an illumination passage area;

a guide mounted to the top surface of the plate and adapted for limiting movement of the slidable light support member in a direction normal to the top surface while allowing movement of the slidable light support member in a direction parallel to the top surface between a first position where the illumination passage area covers the hole area and a second position that allows manual access, via the hole area, to space proximate the top surface; and first and second mounting brackets secured with respect to the plate and adapted for securing respective lengthwise ends of the plate to a ceiling structure, one of the mounting brackets abutting the light support member when it is in its second position to form a stop for limiting the movement thereof in the direction parallel to the top surface.

20. A recessed lighting fixture comprising:

a plate having a hole in a center portion thereof and having top and bottom surfaces;

a light support member having laterally-extending members on each of two essentially parallel sides, the laterally-extending members including bearings and each having a thickness; and a pair of parallel spaced guides disposed on the top surface of the plate, each guide having a longitudinal section offset from the top surface by a distance greater than the thickness of the laterally-extending members, wherein the laterally-extending members of the light support member are slidable between the top surface of the plate and the longitudinal section of the guide, so that the light support member is slidable between a first position where the hole is covered by the light support member and a second position where at least a portion of the hole is not covered by the light support member.

21. A method for servicing a recessed lighting fixture, the method comprising:

providing a lighting fixture including (a) a plate defining a light opening therethrough and having top and bottom surfaces, (b) a light support member on the top surface over the light opening and having essentially parallel laterally-extending members on each of two opposite sides, the laterally-extending members each having a thickness, and (c) a guide disposed on the top surface of the plate, the guide having a longitudinal section offset from the top surface by a distance greater than the thickness of the laterally-extending members, the laterally-extending members of the light support member are slidable between the top surface of the plate and the longitudinal section of the guide;

sliding the light support member in such direction parallel to the top surface from a first position where the light support member is aligned with the light opening to a second position where at least a portion of the light opening is not covered by the light support member; and servicing the lighting fixture through the uncovered portion of the light opening.

22. The method of claim 21 wherein the lighting fixture has a reflector extending from the light support member through the light opening, and the method further includes the step of removing the reflector prior to the sliding the light support member.

* * * * *